US006287364B1

(12) United States Patent
Mizuta et al.

(10) Patent No.: US 6,287,364 B1
(45) Date of Patent: Sep. 11, 2001

(54) METHOD FOR PRODUCING COPPER ALLOY INGOT

(75) Inventors: Taiji Mizuta; Fumio Morimune, both of Fukui; Mitsuo Tomonaga; Takayoshi Miyazaki, both of Kobe, all of (JP)

(73) Assignees: Osaka Alloying Works, Co., Ltd., Fukui; Kabushiki Kaisha Kobe Seiko Sho, Kobe, both of (JP)

( * ) Notice: Subject to any disclaimer, the term of this patent is extended or adjusted under 35 U.S.C. 154(b) by 0 days.

(21) Appl. No.: 09/473,947

(22) Filed: Dec. 29, 1999

(30) Foreign Application Priority Data

Mar. 1, 1999 (JP) ..... 11-052623

(51) Int. Cl.[7] ..... C22B 15/14
(52) U.S. Cl. ..... 75/646; 75/10.16
(58) Field of Search ..... 75/646, 652, 651, 75/648, 10.16

(56) References Cited

U.S. PATENT DOCUMENTS 5,364,449 * 11/1994 Nakamura et al. ..... 75/650
6,024,779 * 2/2000 Snell ..... 75/652

FOREIGN PATENT DOCUMENTS 63-293124 11/1988 (JP) .
5-220567 8/1993 (JP) .

OTHER PUBLICATIONS

Nippon Shindo Kyokai, pp. 34–37, 54–55, "Basics and Industrial Technology About Copper and Copper Alloy," May 25, 1988 (with partial English Translation).
Nikkan Kogyo Shinbun Sha, p. 190, "Terminology Dictionary on Casting with Illustration," Nov. 30, 1995 (with partial English Translation).

* cited by examiner

*Primary Examiner*—Roy King
*Assistant Examiner*—Tima M. McGuthry-Banks
(74) *Attorney, Agent, or Firm*—Oblon, Spivak, McClelland, Maier & Neustadt, P.C.

(57) ABSTRACT

A method for producing a copper alloy ingot with suppressed casting defects, segregation of components and lower oxide content comprising heating a copper alloy material in a graphite crucible to melt the copper alloy material. The molten alloy in the graphite crucible is cooled from the bottom of the crucible so that the molten alloy solidifies in a single direction.

13 Claims, 15 Drawing Sheets

SECONDARY ELECTRON IMAGE

METHOD FOR PRODUCING COPPER ALLOY INGOT

BACKGROUND OF THE INVENTION

1. Field of the Invention

The present invention relates to a useful method for producing a high quality and sound copper alloy ingot while suppressing casting defects, segregation and oxide content.

2. Description of the Prior Art

A vacuum melting casting method has hitherto been employed for producing a copper alloy ingot, which is free from oxides and contains a reduced number of pinholes caused by dissolved oxygen or dissolved hydrogen. In addition, various attempts have been made, which include directional solidification under vacuum or in an argon gas atmosphere, in order to produce a sound ingot having less shrinkage cavities, segregation of components and other defects. The shrinkage cavities, which are usually caused during solidifying the molten metal, include macroscopic shrinkage cavities (e.g., center shrinkage cavity and final shrinkage cavity) and microscopic shrinkage cavities (e.g., shrinkage cavity observed in grain boundaries under a microscope). The conventional melting casting techniques commonly employ such procedure as, after the copper alloy material is molten in a crucible, a molten metal is poured into another container (casting mold) and then cooled to thereby solidify the molten metal.

However, the above conventional methods for melting and casting a copper alloy have a variety of problems, especially because there is provided the step of pouring the molten metal into the casting mold. The problems includes poor workability and productivity, complicated operations required to control the molten metal temperature during the pouring step, the low cooling efficiency of the casting mold leading to greater feeding and higher equipment investment, thus resulting in higher producing cost. When the material is poured or molten in air rather than under vacuum or in an argon gas atmosphere to prevent these problems, there arises a problem that oxides are entrained in the step of pouring or melting the molten metal.

SUMMARY OF THE INVENTION

To solve the above problems, an object of the present invention is to provide a method capable of producing a sound copper alloy ingot with a reduced number of casting defects, segregation and oxide content at low cost, while improving the workability and productivity with reasonable molten metal control operation and minimum feeding.

According to an aspect of the present invention, a method for producing a copper alloy ingot includes steps of heating a copper alloy material in a graphite crucible to melt the copper alloy material, and cooling the molten metal in the crucible from a bottom of the crucible so that the molten metal solidifies in a single direction.

DESCRIPTION OF THE PREFERRED EMBODIMENTS

Figure 1:
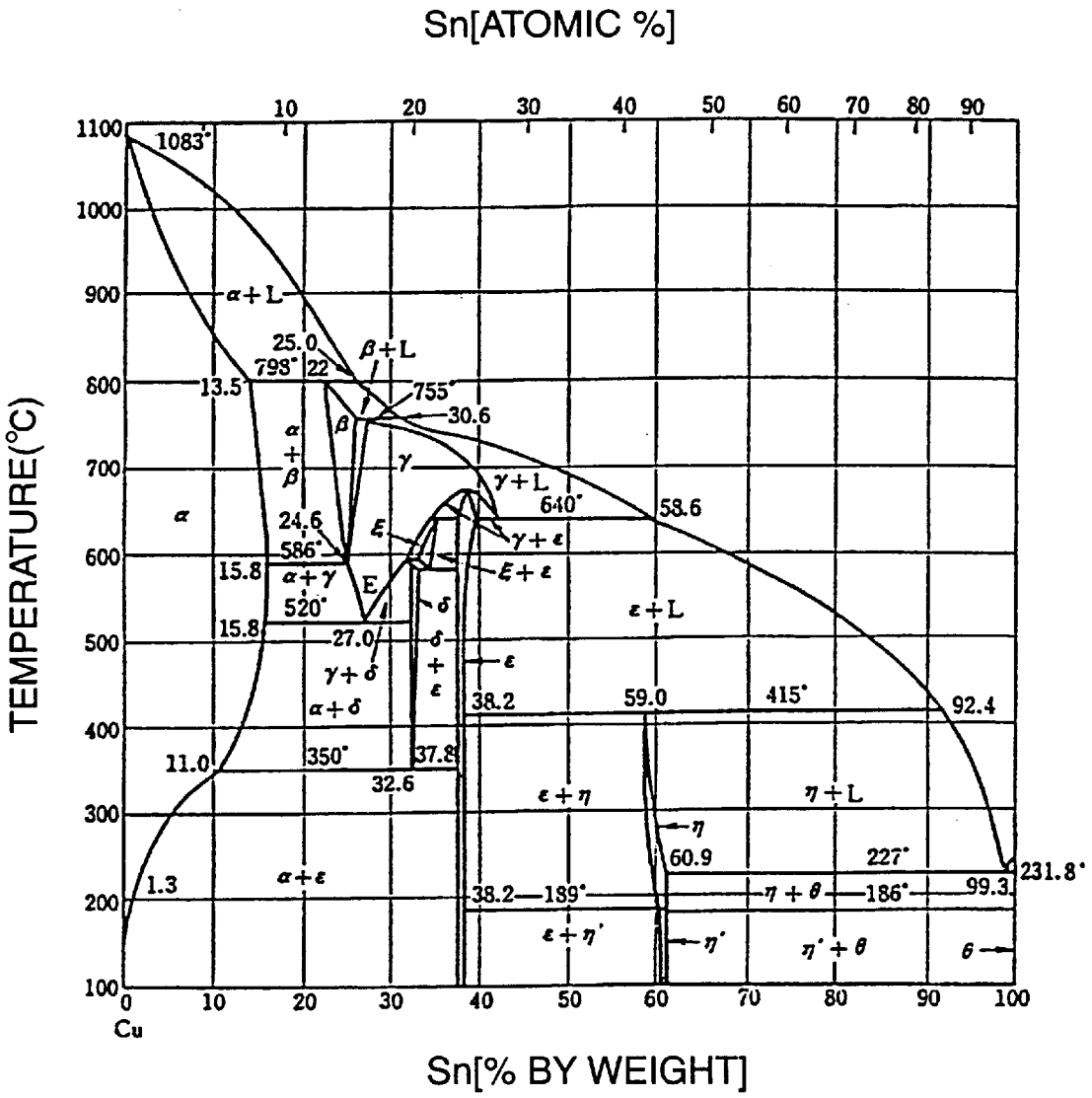
FIG. 1 is a Cu—Sn equilibrium state diagram.

The present inventors have studied intensively to attain the above object. As a result, the inventors have found that the casting problem such as entrainment of oxides and gas inclusion can be prevented and internal quality can be improved by melting a copper alloy in a graphite crucible and then rapidly cooling a molten metal in the crucible, to solidify the molten metal in a single direction. Main features of the above method include using the same crucible for melting and cooling, and solidifying in a single direction. That is, in this method, it is not necessary to transfer the molten metal from the crucible to a casting mold to be solidified.

Although the mechanism that the above method solves the casting problems described above cannot be completely explained, it can be understood that solidification of a molten metal in a crucible without transferring therefrom makes it possible to maintain the reducing zone, thereby preventing the molten metal from entraining the air as well as the oxide of the molten metal that comes into existence due to reaction of the molten metal with the air.

In addition, the present invention may preferably include (1) shielding the copper alloy material in the crucible with inert gas such as argon gas until the material starts melting, and then, (2) after the material starts melting, covering the molten metal surface with a carbon-based substance such as carbon chips, carbon powders or carbon-based flux. This makes it possible to insulate the molten metal from the air containing moisture, to thereby achieve a reducing zone around the molten metal. The reducing zone can prevent production of oxides in the metal and absorption of hydrogen by the metal. Furthermore, by the above covering (2), the reducing zone to insulate the molten metal from the air can be attained without closing the crucible with a lid. Thus, if necessary, a desired additional component can be mixed with the molten metal in the melting step while maintaining the reducing zone.

When the molten metal surface is covered with the carbon chips, carbon powders or the carbon-based flux, a part of such material is likely to deposit on the inner surface of the crucible. This is prevented by applying argon gas bubbling after melting, to thereby separate the carbon chips, carbon powders or the carbon-based flux through floatation while degassing from the molten metal.

Examples of the copper alloy obtained by the present invention include superconductive copper alloy billets containing about 13 to 15.8% of Sn and Cu as balance. In order to improve the superconductivity of the copper alloy, the copper alloy may further include a small amount (e.g., 0.3% or less) of an element such as Ti. Ti operates as the deoxidizing agent removing the residual oxygen in the molten metal. Therefore, when the element is added before conducting the argon gas bubbling in the method of the present invention, the element is likely to react with a trace amount of oxygen or moisture contained in the argon gas and is oxidized. The oxided element floats to the molten metal surface during the bubbling, thus canceling the effect of adding the element. In order to avoid such a disadvantage, it is preferred, when a reducing element, i.e., an element having a strong affinity with oxygen, such as Ti is added as an alloy component, to add it after the completion of the argon gas bubbling.

In the method of the present invention, to rapid cool from the bottom of the molten metal in the crucible for directional solidification, it is preferred to spray cooling water (hereinafter also referred to as "showering") to the outer surface of the crucible while moving the crucible relative to the cooling water spray in a single direction. This unidirectional solidification of the molten copper alloy can prevent the occurrence of macroscopic shrinkage cavities. In addition, efficient cooling of the molten metal through the graphite crucible having a high heat transmission can minimize the occurrence of microscopic shrinkage cavities, pinholes, segregation of components and other defects. Also, the solidification method can provide fine and desirable microstructure to the final alloy ingot. Specifically, this method includes lowering the graphite crucible containing the molten alloy into cooling water sprayed from a showering device, or raising a showering device along the outer surface of the fixed crucible.

According to the method of the present invention, it is also effective to apply electromagnetic stirring to a portion of the molten metal in the crucible above the interface of solidification which is being showered. This activates the molten metal in this region so as to further suppress formation of microscopic shrinkage cavities and segregation, and further refine the structure of in the final alloy ingot.

The copper alloy used in the present invention is not specifically limited and there can be used various bronze alloys for general purpose, in addition to the above-described Cu—13–15.8%Sn alloy (a small amount of Ti is added as required).

With the conventional casting method, the Cu—Sn copper alloy described above has been limited to such constitutions as the Sn content is not higher than about 14% by weight due to the problems described previously (e.g., the occurrence of segregation), although solid solubility limit of Sn into a solid solution is about 15.8% by weight as shown in FIG. 1 (Cu—Sn equilibrium state diagram). The method of the present invention, however, has such an effect as the content of the alloy element can be increased to 15.5% by weight that is near the solid solubility limit, since the disadvantages such as segregation can be avoided. The increased amount of the additional Sn improves the superconducting performance of the alloy.

Next, the present invention will now be described in detail below by way of a preferred embodiment. The following embodiment is not intended to limit the scope of the present invention, and it will be understood that any modification or alteration of the features herein is included in the scope of the present invention. The method of the present invention may also be referred to as a "Mizuta system", hereinafter.

Figure 2:
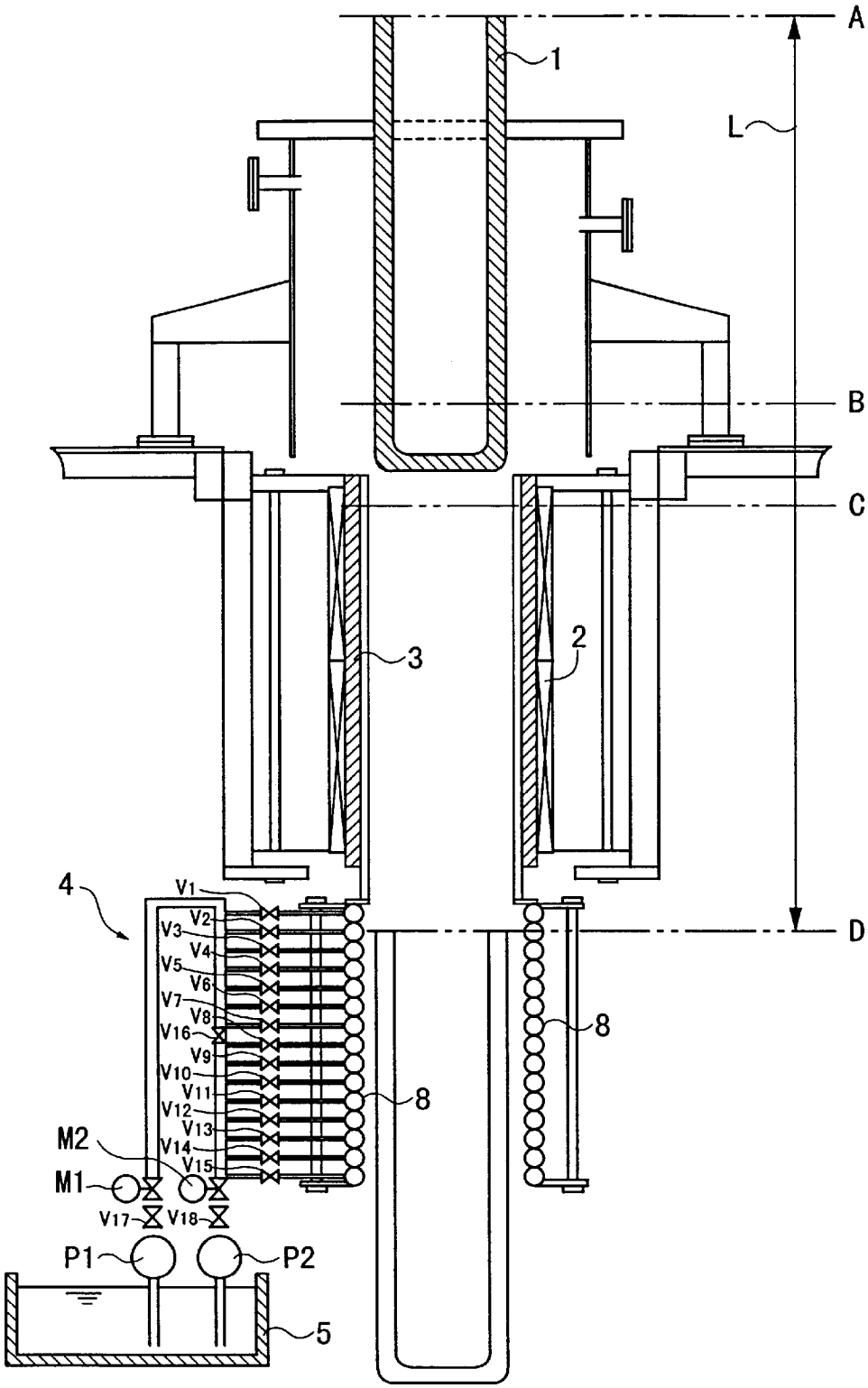
FIG. 2 schematically shows a construction of a casting equipment for carrying out a method of the present invention.

FIG. 2 schematically shows a construction of a casting facility for carrying out the Mizuta system. The facility has a graphite crucible 1, a high frequency coil 2, a heat insulating sleeve 3, and a showering device 4. The showering device 4 is provided with associated devices such as a water tank 5, pumps P1, P2, motor-operated valves M1, M2, flow control valves V1 to V18 and spay nozzles 8 arranged in a circle (15 nozzles in this drawing). In the showering device 4, the pumps P1, P2 pump up cooling water from the water tank 5, the flow rate of the cooling water is controlled by the motor-operated valves M1, M2 and the flow control valves V1 to V18, and the cooling water is sprayed from the spray nozzles 8.

Although not shown in detail in FIG. 2, the graphite crucible 1 is provided with a hydraulic cylinder with a support base made of heat-resistant cement being secured at an end of a rod that extends from the hydraulic cylinder. The graphite crucible 1 is placed on the support base so that the graphite crucible 1 can be raised and lowered by extending and retracting the hydraulic cylinder. The hydraulic cylinder has a stroke of motion indicated with L in the drawing. By the cylinder movement, the graphite crucible 1 can move up until the bottom of the graphite crucible 1 reaches the top of the high frequency coil (the position is shown in FIG. 2 as "A") and down until the top of the graphite crucible 1 reaches a little below the top of the showering device 4 (the position is shown in FIG. 2 as "D").

Procedure of the Mizuta system using the casting facility described above will be described below. First, the graphite crucible 1 is raised to a proper height in such a manner that the position of the upper end of the crucible is set at the position indicated by "A", and specified masses of pure copper and pure tin (to obtain the proportion of pure tin of, for example, from 13 to 15.5% by weight) are charged into the crucible. Then the crucible is lowered into the high frequency coil 2 to start melting by induction heating. The position of the upper end of the crucible at the start of melting is indicated by "B" in FIG. 2.

After charging pure copper and pure tin into the graphite crucible 1, a lid (not shown) is put on the graphite crucible 1 and the inside and surrounding of the crucible shielded with argon gas. When the pure copper begins to melt, the lid is removed and carbon powders (or carbon-based flux) are sprinkled on the material surface. Thereafter, the material (i.e., molten metal) is prevented from the absorption of oxygen in the air by carbon chips or carbon powders, to let the whole material melt while occasionally supplying carbon chips or carbon powders.

When the copper alloy material is completely melted, the temperature is raised to the temperature 100° C. higher than the solidification starting temperature, while monitoring the molten metal temperature. This makes it possible that the feeding operates effeciently. In addition, since the temperature is not too high, an excessive amount of hydrogen will not be absorbed by the molten metal due to overheat. Then argon gas is supplied through a graphite pipe at a proper flow rate to carry out bubbling for several minutes hereby to cause the carbon chips or carbon Powders deposited on the inner surface of the crucible to float sufficiently. After the bubbling, an alloy element (the third element) such as Ti is charged into the molten metal as required, and the crucible is set stationary so that the third element diffuses into the molten metal.

Then while lowering the graphite crucible 1 at a proper speed, cooling water is sprayed from the nozzles of the showering device 4 to thereby rapidly cool down the external surface of the crucible. (In FIG. 2, the position of the upper end of the crucible at the start of cooling is indicated by "C".) At this time, the following three zones are formed in the copper alloy contained in the crucible: a completely solidification zone formed from the bottom of the crucible; a melting zone; and a transition zone formed between the completely solidification zone and the melting zone. The alloy in the transition zone has a temperature ranging from the solidification starting temperature (at the upper surface of the zone) to the solidification completion temperature (at the lower surface of the zone). The molten metal in the melting and transition zones may be stirred. Preferably, the molten metal being solidified in the transition zone is moved by stirring, for example, with the use of an electromagnetic stirrer by supplying high-frequency power. The stirring of the molten metal in this zone can further suppress formation of microscopic shrinkage cavities and inverse segregation of tin, and makes the structure finer. Cooling is stopped when the entire copper alloy in the crucible is completely solidified. (In FIG. 2, the position of the upper end of the crucible at the end of cooling is indicated by "D".) Although FIG. 2 shows the construction where the graphite crucible containing the molten copper alloy is lowered into cooling water sprayed from the showering device, the facility is not limited to the construction shown in FIG. 2. Such a construction may be used as the showering device is raised along the outer surface of the fixed crucible. To sum up, applied can be any construction where the crucible moves relative to the cooling water spray in a single direction.

Figure 3:
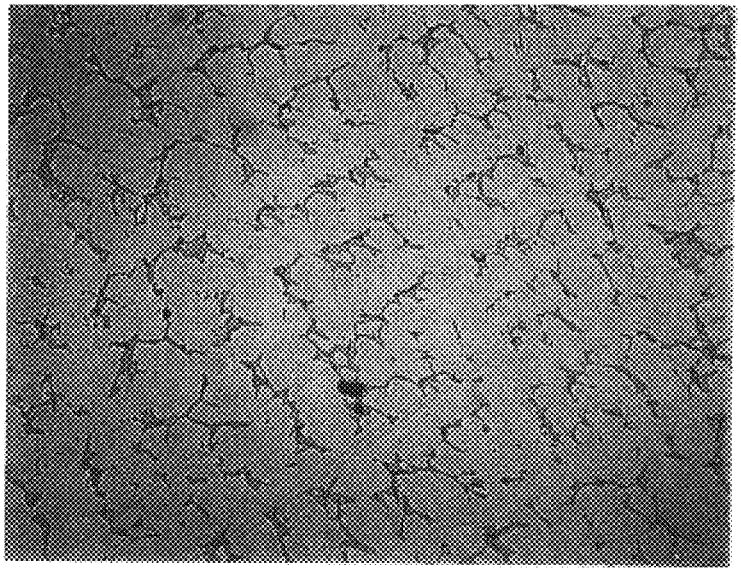
FIGS. 3 to 5 are photographs showing microstructures of a section of a copper alloy solidified without using an electromagnetic stirrer by using the casting equipment shown in FIG. 2, FIG. 3 showing a microstructure being at position of 72 mm in a radial direction from the center, FIG. 4 showing a microstructure being at position of 36 mm in radial direction from the center, and FIG. 5 showing a microstructure being at the center.
Figure 4:
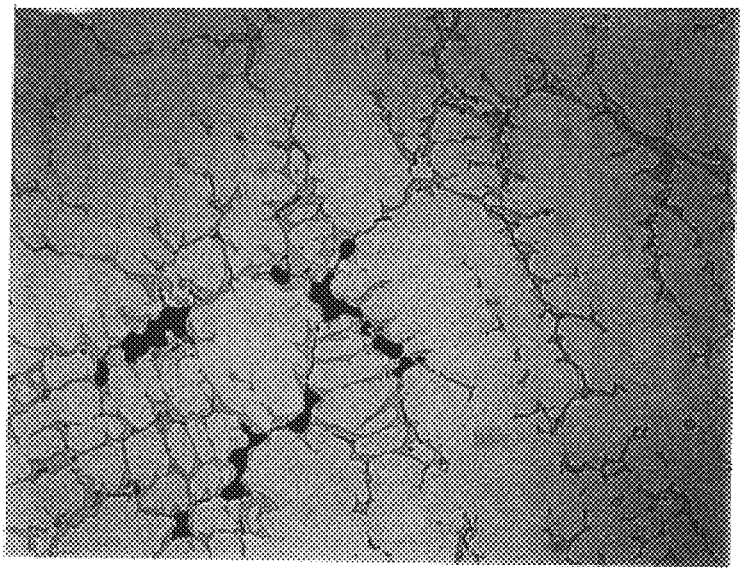
Figure 5:
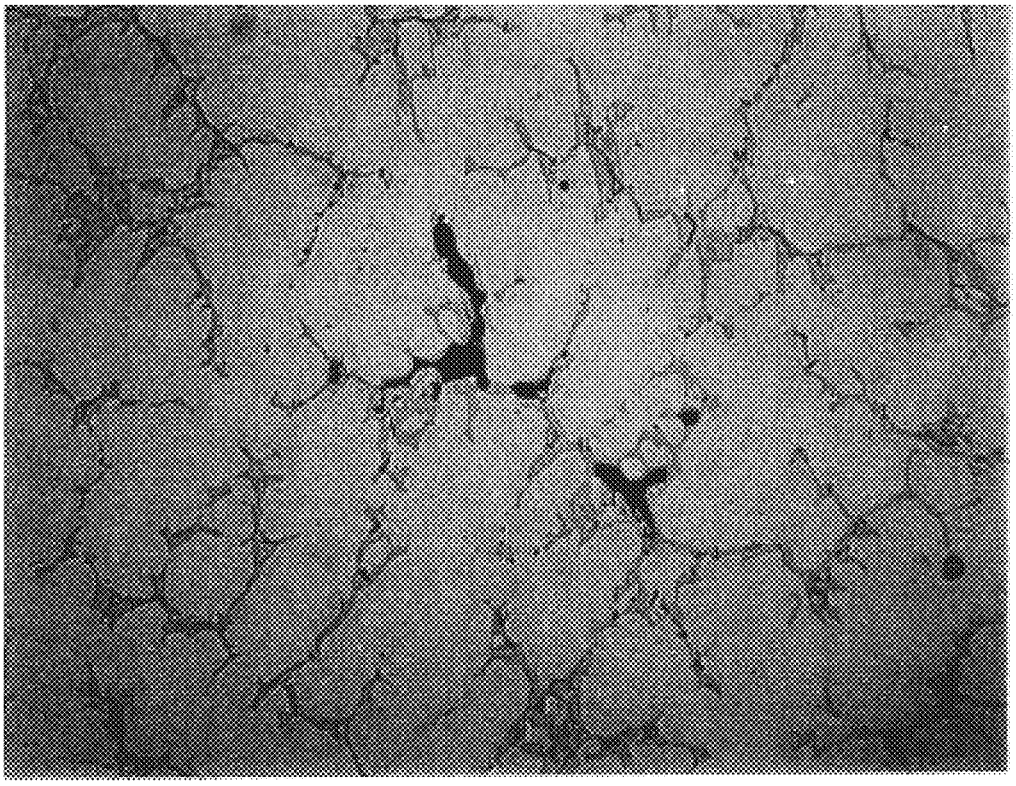

Examples of solidification structure of a copper alloy ingot cast by the casting equipment described above are shown in FIGS. 3 to 5. These photographs show microstructures (magnified 100 times) at height of 600 mm from the bottom of a copper alloy ingot (Cu, 14% Sn, 0.3% Ti: 180 mm (diameter), 700 mm high) obtained without electromagnetic stirring. FIG. 3 shows a sample taken from a position of 72 mm in a radial direction, FIG. 4 shows a sample taken from a position of 36 mm in a radial direction, and FIG. 5 shows a sample taken from the center. These photographs show portions where shrinkage cavities were observed, and only slight shrinkage cavities can be seen as a whole. Although not shown in the photographs, similar structure was seen at a height of 150 mm. Therefore, it is supposed that the ingot has a similar structure at any height except for the portion near the bottom.

Figure 6A:
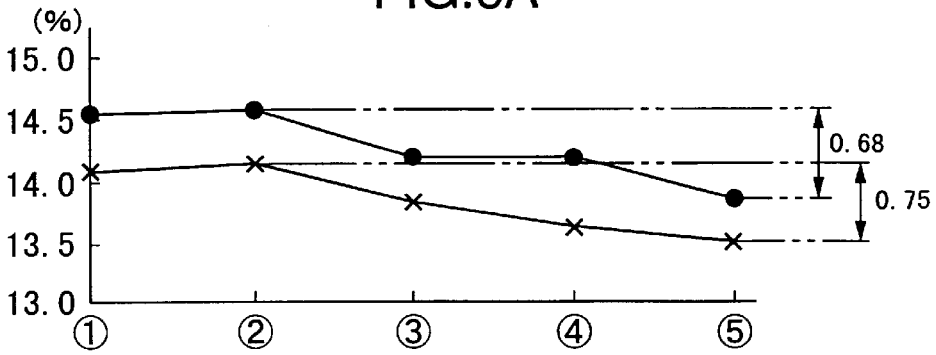
FIGS. 6A to 6D are graphs showing an influence of electromagnetic stirring on the inverse segregation of tin.
Figure 6B:
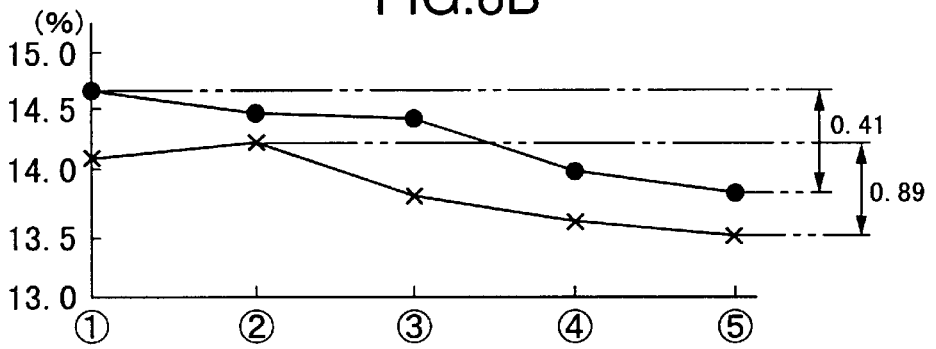
Figure 6C:
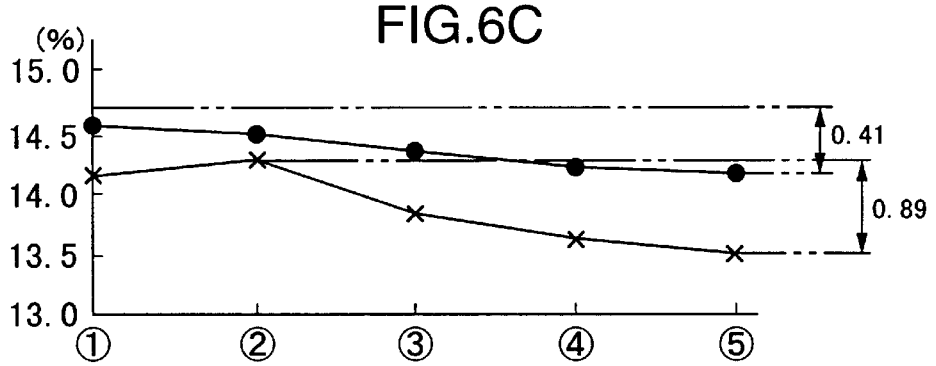
Figure 6D:
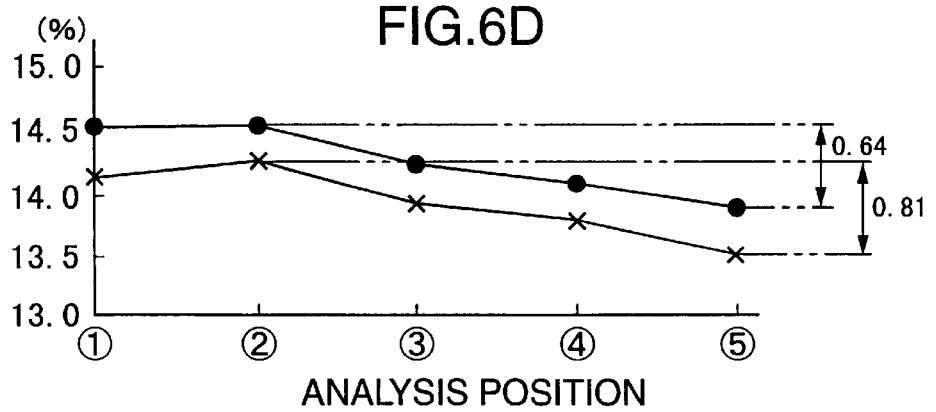

The present inventors studied about the influence of the electromagnetic stirring on the inverse segregation when a copper alloy ingot measuring 180 mm in diameter and 700 mm in height is cast by using the casting facility described above. The results are shown in FIG. 6. In the drawing, the reference symbol "●" shows a plot of measurement when electromagnetic stirring was applied, and the reference symbol "×" shows a plot of measurement when electromagnetic stirring was not applied. FIG. GA shows measurements at a height of 150 mm above the bottom of the ingot, FIG. 6B shows measurements at a height of 300 mm above the bottom of the ingot, FIG. 6C shows measurements at a height of 450 mm above the bottom of the ingot, and FIG. 6D shows measurements at a height of 600 mm above the bottom of the ingot. Measurements at sampling positions ① to ⑤ in the radial direction shown in FIGS. 6A to 6D are taken at 72 mm from the center for ①, at 57 mm from the center for ②, 36 mm from the center for ③, 18 mm from the center for ④ and 0 mm (i.e., center) for ⑤.

As is apparent from these results, it is effective in restricting segregation to solidifying the molten metal while applying electromagnetic stirring.

Figure 7:
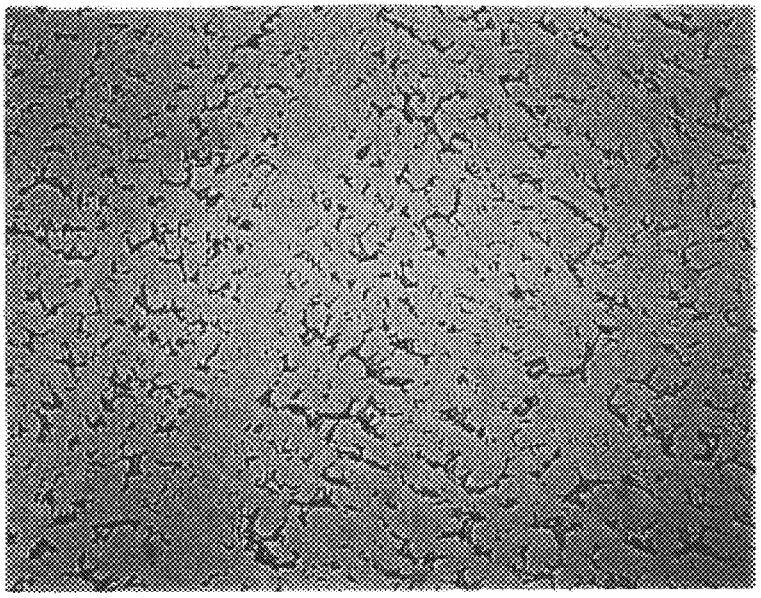
FIGS. 7 to 9 are photographs showing microstructures of a section of a copper alloy ingot solidified with the use of an electromagnetically stirrer, FIG. 7 showing a microstructure being at the 72 mm in radial direction from the center, FIG. 8 showing a microstructure being at position of 36 mm in radial direction from the center, and FIG. 9 showing a microstructure being at the center.
Figure 8:
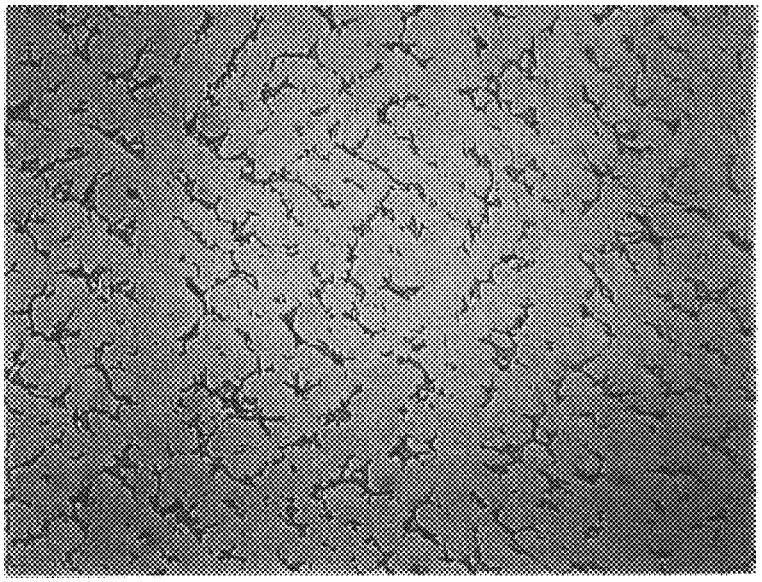
Figure 9:
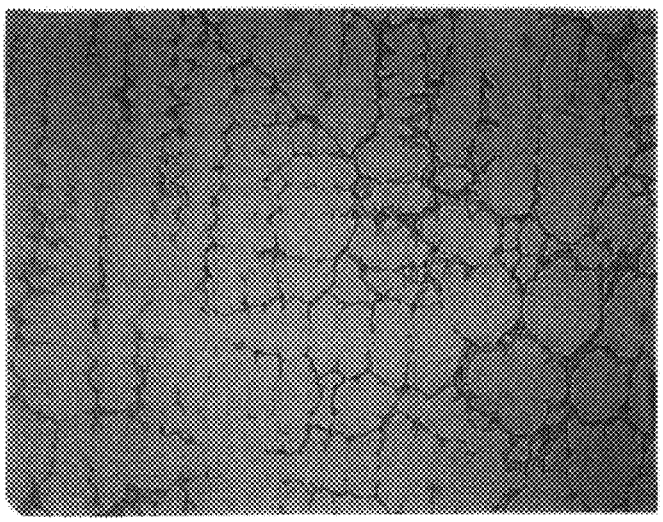

Examples of solidification structure of a copper alloy ingot (Cu—14%Sn—0.3%Ti: 180 mm (diameter), 700 mm high) obtained while being electromagnetically stirred are shown in FIGS. 7 to 9 (microscope photographs). These photographs show microstructures (magnified 100 times) at height of 600 mm from the bottom. FIG. 7 shows a sample taken from a position of 72 mm in a radial direction, FIG. 8 shows a sample taken from a position of 36 mm in a radial direction, and FIG. 9 shows a sample taken from the center. These photographs show that the number of shrinkage cavities are less than those shown in FIGS. 3 to 5 and also the cast structure is finer.

Figure 10:
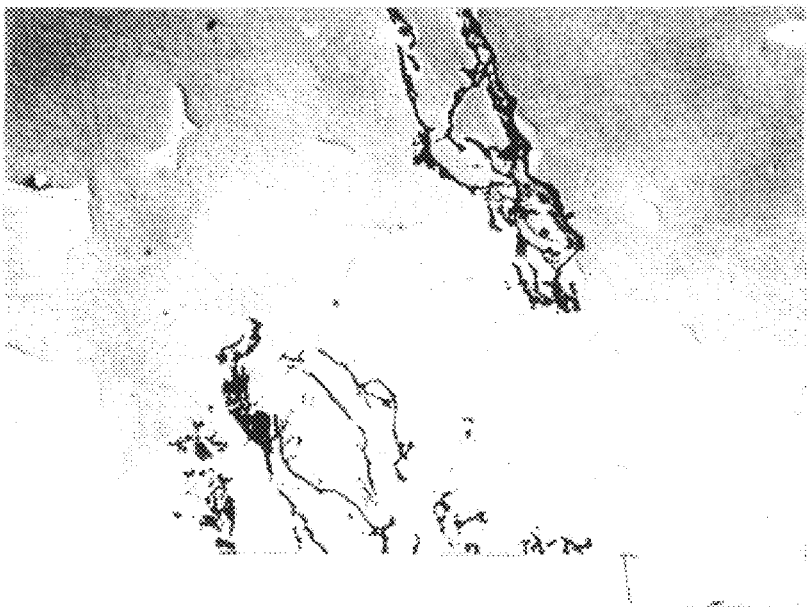
FIG.10 PRIOR ART
FIGS. 10 to 13 are photographs showing a microstructure of a copper alloy ingot containing an oxide entrained during pouring operation in a conventional method, FIG. 10 showing a secondary electron image, FIG. 11 showing a C—K $\alpha$ image, FIG. 12 showing a Ti—K $\alpha$ image, and FIG. 13 showing an O—K $\alpha$ image.
Figure 11:
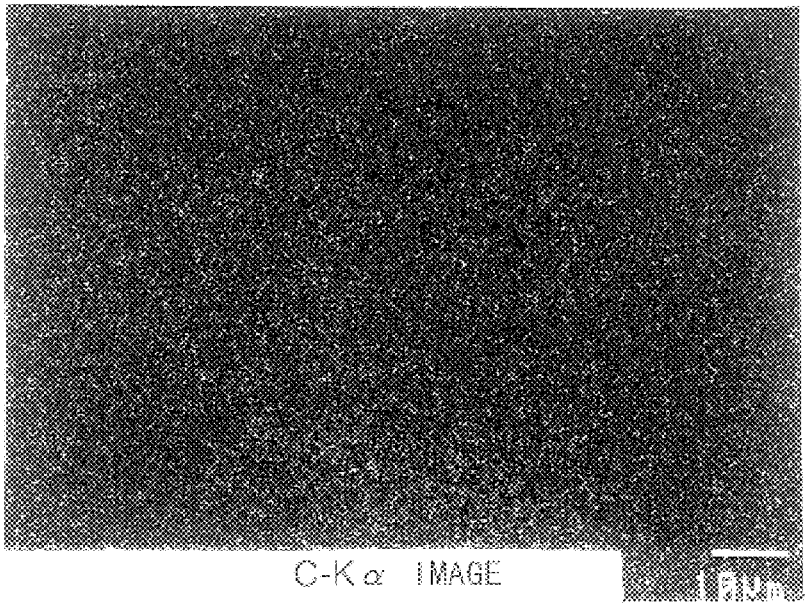
FIG.11 PRIOR ART
Figure 12:
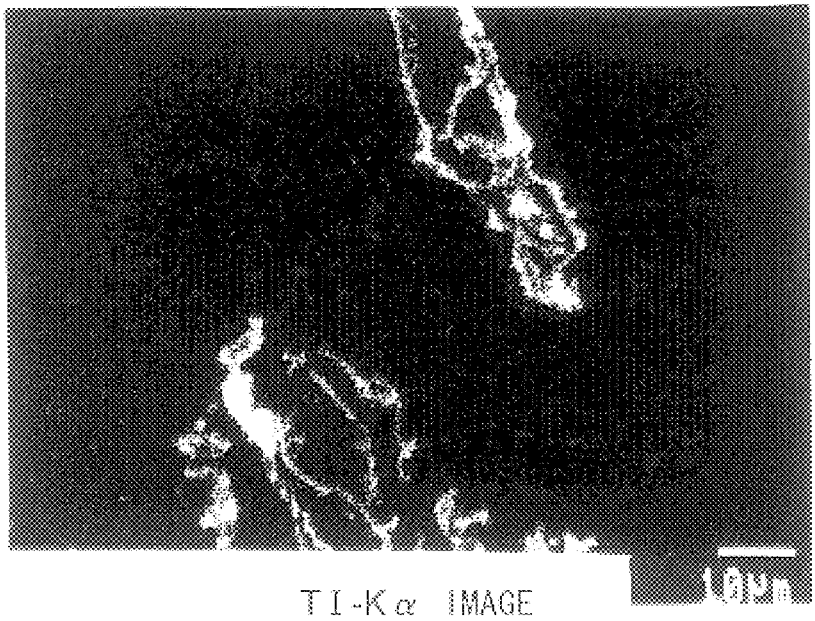
FIG.12 PRIOR ART
Figure 13:
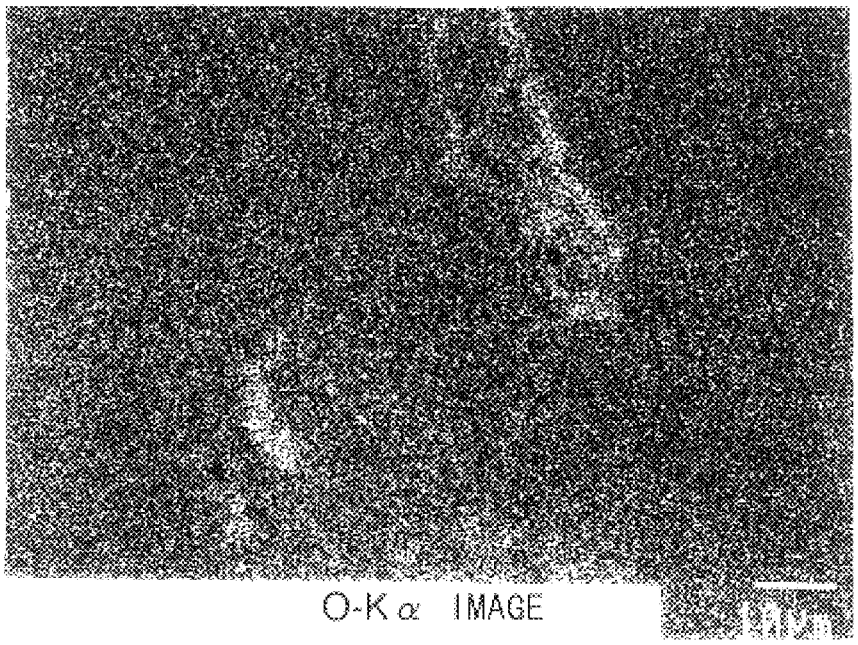
FIG.13 PRIOR ART
Figure 14:
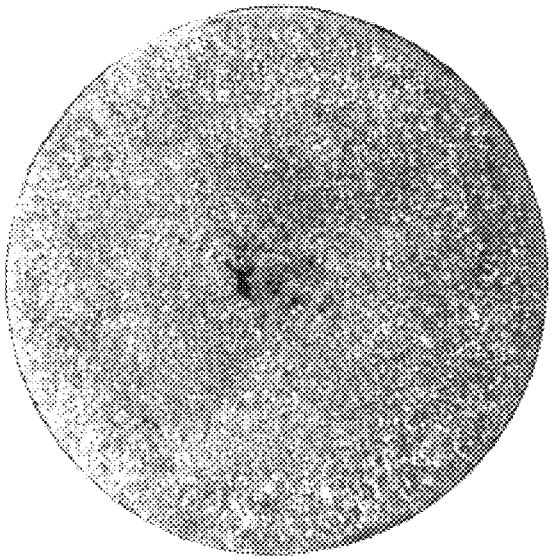
FIG.14 PRIOR ART
FIG. 14 is a photograph showing macroscopic shrinkage cavities (at height of 200 mm from bottom) in a copper alloy ingot produced by the conventional metal mold casting method.
Figure 15:
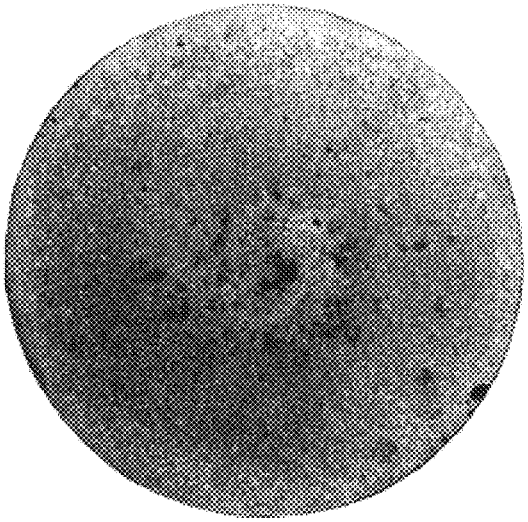
FIG.15 PRIOR ART
FIG. 15 is a photograph showing macroscopic shrinkage cavities (at height of 340 mm from bottom) in a copper alloy ingot produced by metal mold casting of the conventional method.
Figure 16:
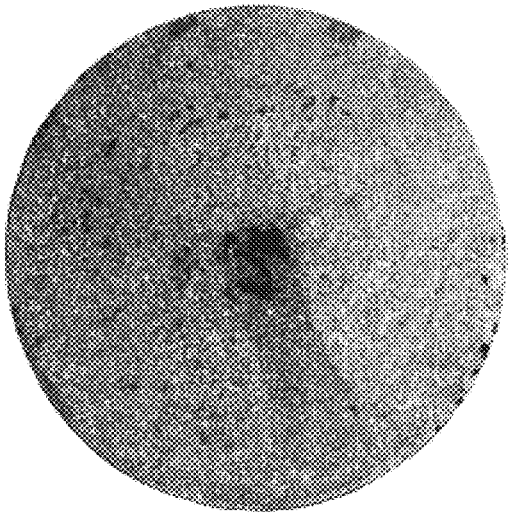
FIG.16 PRIOR ART
FIG. 16 is a photograph showing macroscopic shrinkage cavities (at height of 470 mm from bottom) in a copper alloy ingot produced by metal mold casting of the conventional method.

FIGS. 10 to 13 are photographs showing microstructures of a copper alloy ingot (Cu—14%Sn—0.3%Ti) containing a titanium oxide entrained during pouring operation in a conventional method. FIG. 10 shows a secondary electron image, FIGS. 11 to 13 respectively show a C—K $\alpha$ image, a Ti—K $\alpha$ image and an O—K $\alpha$ image by X-ray microanalyzer. FIGS. 14 to 16 are photographs showing macroscopic shrinkage cavities generated in a copper alloy ingot (Cu—14%Sn—0.3%Ti) produced by the conventional metal mold casting method. FIG. 14 shows a sample taken from a height of 200 mm above the bottom, FIG. 15 shows a sample taken from a height of 340 mm above the bottom of the ingot, and FIG. 16 shows a sample taken from a height of 470 mm.

These results show that the Mizuta system of the present invention produces better microstructure than the conventional method that produces copper alloy ingots having such defects as shown in FIGS. 10 to 16.

Figure 17:
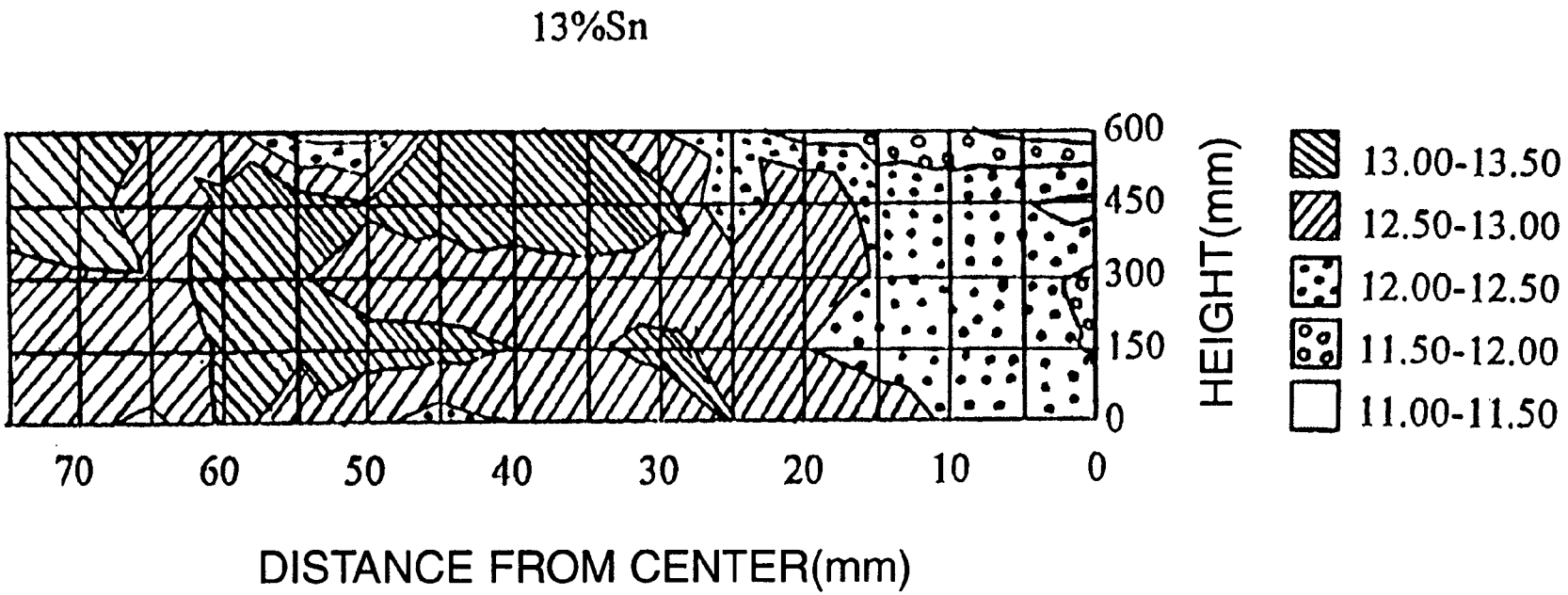
FIG.17 PRIOR ART
FIG. 17 is a graph showing a concentration distribution of tin in a radial direction and in a vertical direction of a copper alloy ingot (containing 13% of Sn) produced by the conventional method.
Figure 18:
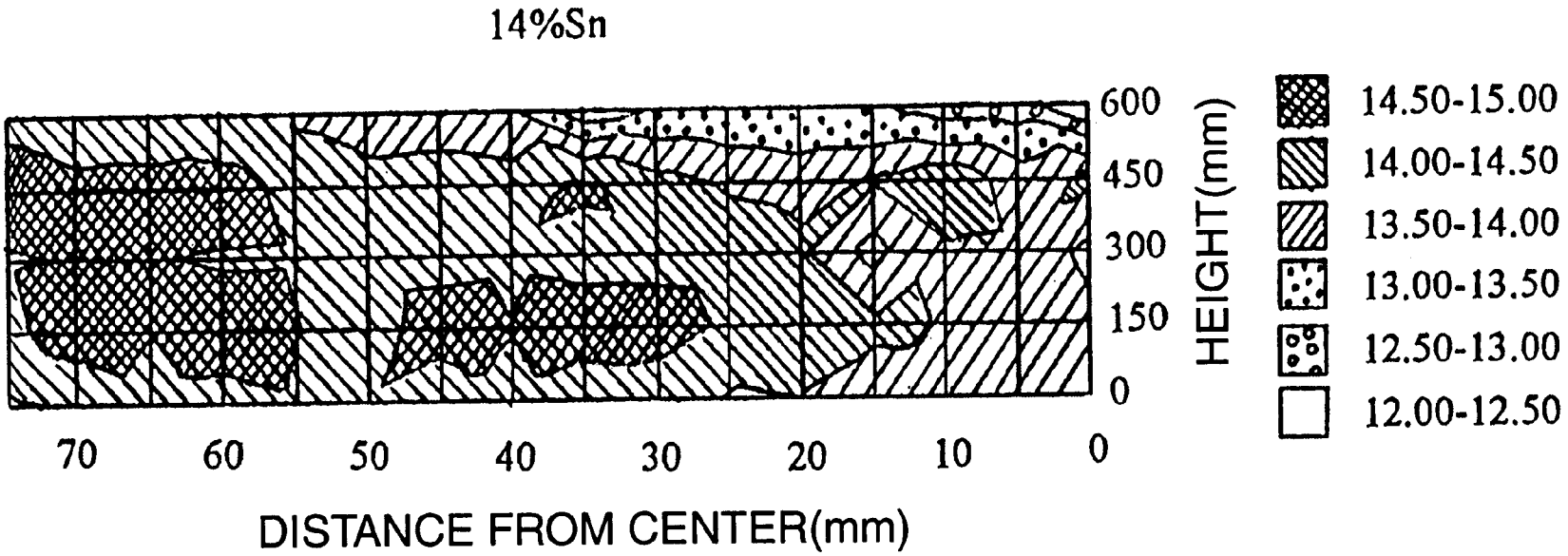
FIG.18 PRIOR ART
FIG. 18 is a graph showing a concentration distribution of tin in a radial direction and in a vertical direction of a copper alloy ingot (containing 14% of Sn) produced by the conventional method.
Figure 19:
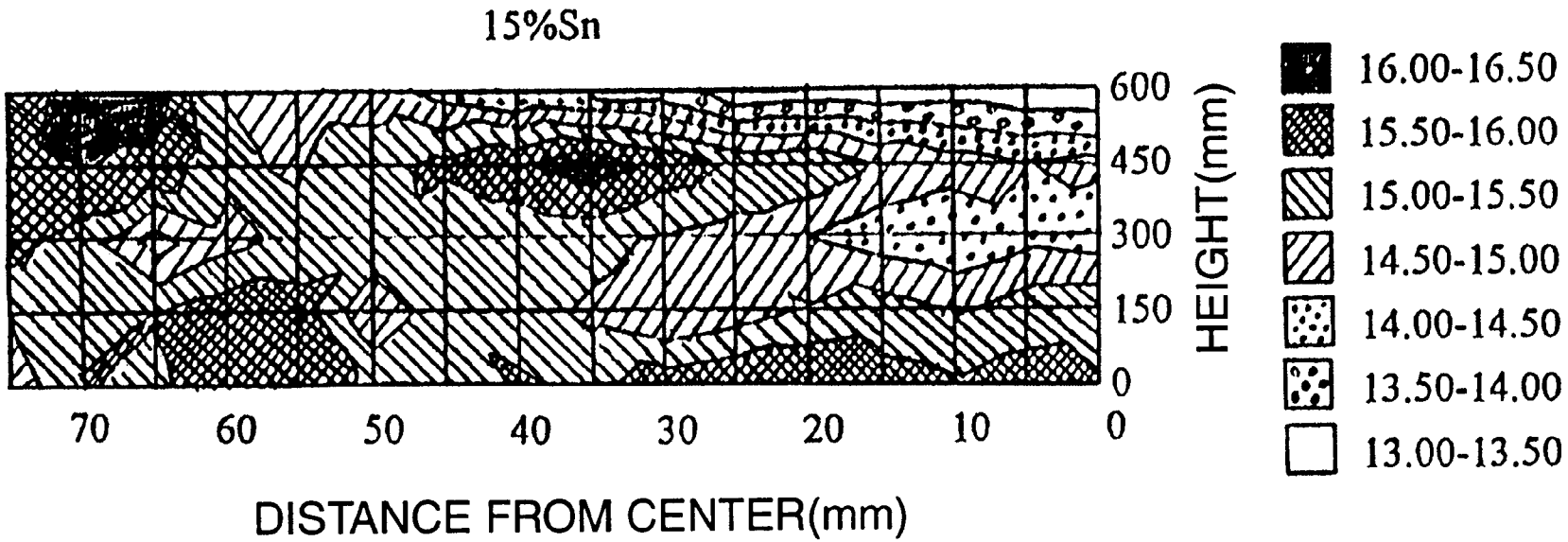
FIG.19 PRIOR ART
FIG. 19 is a graph showing a concentration distribution of tin in a radial direction and in a vertical direction of a copper alloy ingot (containing 15% of Sn) produced by the conventional method.

FIGS. 17 to 19 are graphs showing a concentration distributions of tin in a radial direction and in a vertical direction, measured at sections at height of 0 mm, 150 mm, 300 mm, 450 mm and 600 mm of copper alloy ingots measuring 180 mm in diameter and 700 mm in height produced by the conventional method (vacuum melting casting method). FIGS. 17 to 19 respectively show the ingots containing 13%, 14% and 15% Sn.

Figure 20:
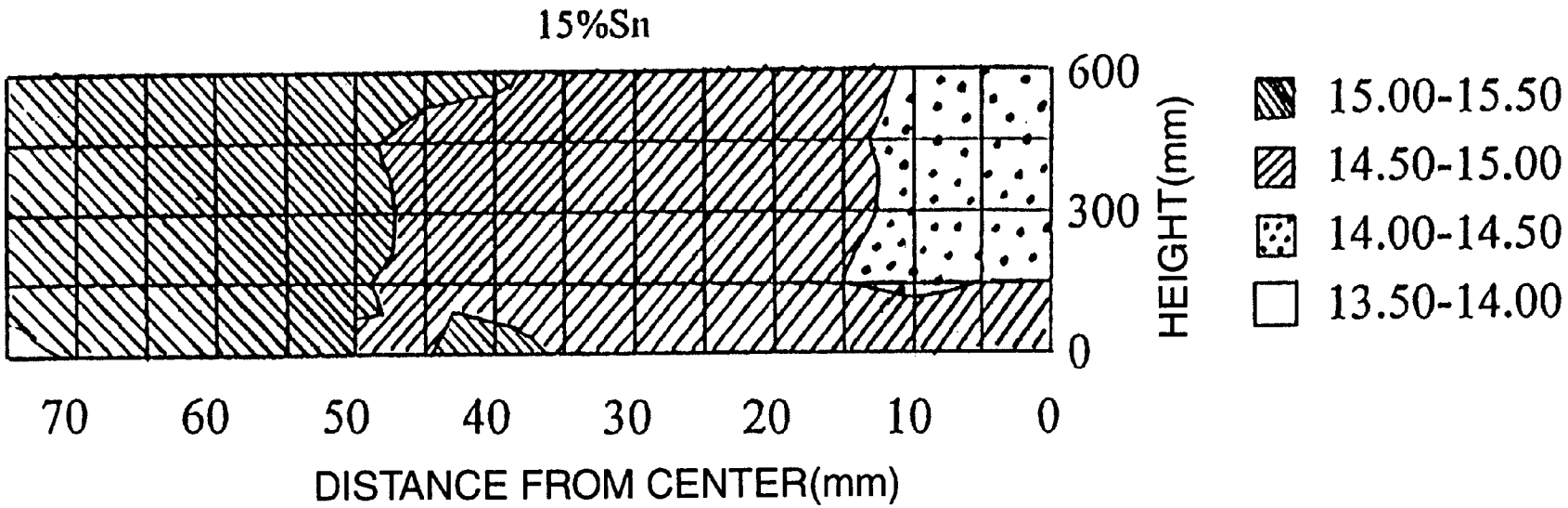
FIGS. 20 and 21 are graphs showing a concentration distribution of tin in a radial direction and in a vertical direction of a copper alloy ingot (containing 15% of Sn) produced by the Mizuta system.
Figure 21:
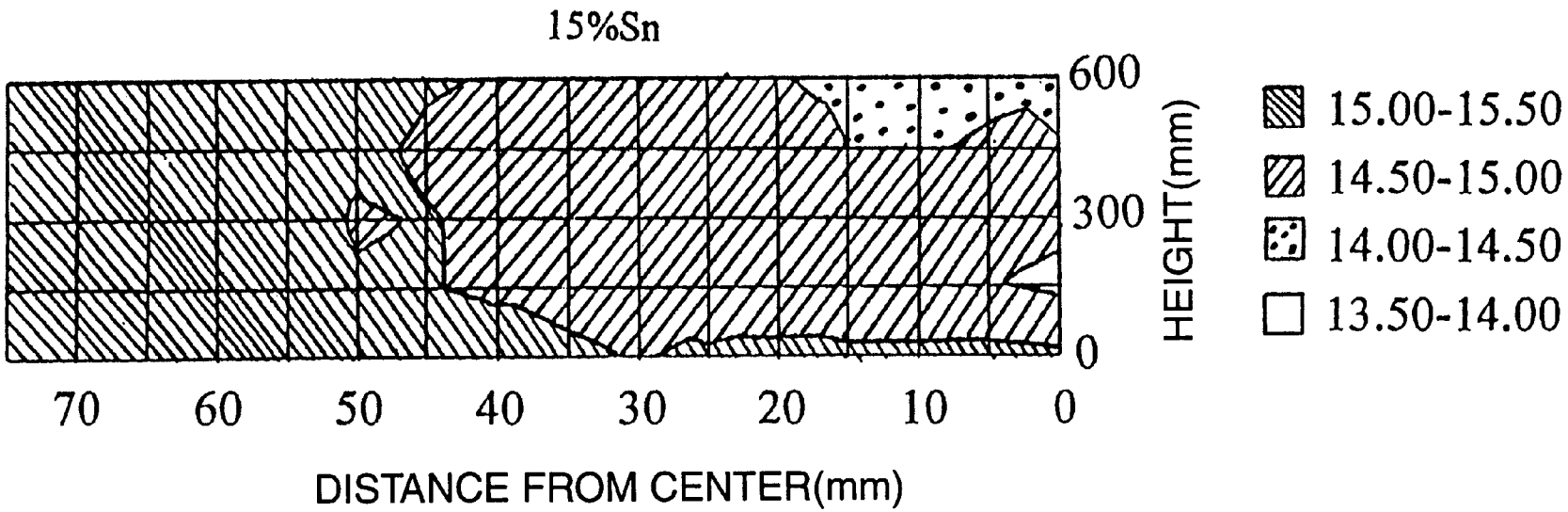

FIGS. 20 and 21 are graphs showing a concentration distributions of tin in a radial direction and in a vertical direction, measured at sections at height of 0 mm, 150 mm, 300 mm, 450 mm and 600 mm of copper alloy ingots (all containing 15%Sn) measuring 180 mm diameter and 700 mm in height produced by the Mizuta system.

As described above, the method according to the present invention is capable of producing a sound copper alloy ingot with suppressed casting defects, segregation and oxide content at low cost, while improving the workability and productivity with reasonable molten metal control operation and minimum feeding.

As will be apparent from FIGS. 17 to 21, the Mizuta system of the present invention also suppresses segregation of tin as compared with the conventional method.

The present invention has been described with reference to the present embodiments. Obviously, modifications and alterations will occur to others upon reading and understanding the proceeding detailed description. It is indeed that the present invention be construed as including all such modifications and alterations insofar as they come within the scope of the attended claims or the equivalents thereof.

What is claimed is:

1. A method for producing a copper alloy ingot, comprising steps of:

heating a copper alloy material in a graphite crucible to melt the copper alloy material; and;

cooling the molten metal in the crucible from a bottom of the crucible so that the molten metal solidifies in a single direction.

2. A method according to claim 1, wherein, after the copper alloy material has started melting in the heating step, a carbon-based substance is supplied over a surface of the molten metal to form a reducing zone near the surface of the molten metal.

3. A method according to claim 2, wherein the carbon-based substance is in the form of chips, powders or flux.

4. A method according to claim 2, wherein, in the heating step, argon gas is supplied in the crucible to form an argon gas shield between the inside of the crucible and the air till the copper alloy material starts melting.

5. A method according to claim 2, further comprising the step of bubbling the molten metal with argon gas after the heating.

6. A method according to claim 5, further comprising the step of adding an element having a stronger affinity with oxygen than that of the carbon-based substance after the argon gas bubbling.

7. A method according to claim 1, wherein the molten metal is cooled by a cooling water spray in the cooling step.

8. A method according to claim 7, wherein, in the cooling step, the molten metal is cooled while moving the crucible relative to the cooling water spray in the single direction.

9. A method according to claim 1, wherein the molten metal in the crucible is electromagnetically stirred in the cooling step.

10. A method according to claim 1, wherein the copper alloy material is heated to a temperature 100° C. higher than a solidification starting temperature at which the copper alloy material starts solidifying.

11. A method according to claim 6, wherein said element having a stronger affinity with oxygen than that of the carbon-based substance is Ti.

12. A method according to claim 1, wherein said copper alloy is a copper-tin alloy.

13. A method according to claim 12, wherein said copper-tin alloy contains about 13–15.8% by weight of tin.

* * * * *